US009814105B2

(12) United States Patent
Chiu et al.

(10) Patent No.: US 9,814,105 B2
(45) Date of Patent: Nov. 7, 2017

(54) CONTROL CIRCUIT FOR LED AND ACTIVE BLEEDER THEREOF

(71) Applicant: SEMICONDUCTOR COMPONENTS INDUSTRIES, LLC, Phoenix, AZ (US)

(72) Inventors: Chen-Hua Chiu, New Taipei (TW); Moon-Ho Choi, Seoul (KR); Gwan-Bon Koo, Gyeonggi-do (KR)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 15/347,987

(22) Filed: Nov. 10, 2016

(65) Prior Publication Data

US 2017/0142797 A1 May 18, 2017

Related U.S. Application Data

(60) Provisional application No. 62/254,251, filed on Nov. 12, 2015.

(51) Int. Cl.
*H05B 37/02* (2006.01)
*H05B 33/08* (2006.01)

(52) U.S. Cl.
CPC ..... *H05B 33/0809* (2013.01)

(58) Field of Classification Search
CPC .... H05B 39/09; H05B 41/34; H05B 33/0803; H05B 37/02; H05B 33/0842; H05B 41/28; H05B 41/295; H05B 41/2827; H05B 41/3925; H05B 37/029; H05B 39/045; H05B 41/2825; Y02B 20/202; A63J 17/00; B23Q 35/128; G09F 13/26; A61N 5/0618; A61N 2005/0663
USPC ..... 315/291
See application file for complete search history.

(56) References Cited

U.S. PATENT DOCUMENTS

2011/0199011 A1* 8/2011 Nakazawa ..... G09G 3/342 315/193
2012/0319610 A1* 12/2012 Yoshinaga ..... H05B 33/0848 315/210
2015/0156841 A1* 6/2015 Musch ..... H05B 33/083 315/186
2015/0312988 A1* 10/2015 Liao ..... H05B 33/0845 315/119

FOREIGN PATENT DOCUMENTS

CN 102238777 A 11/2011
TW 201134305 A 10/2011
TW 201146087 A 12/2011
TW 201204168 A 1/2012
TW 201448659 A 12/2014
TW 201630468 A 8/2016

* cited by examiner

*Primary Examiner* — Minh D A
(74) *Attorney, Agent, or Firm* — Robert F. Hightower

(57) ABSTRACT

A control circuit for LED and an active bleeder thereof are provided. The control circuit comprises an LED driver and the active bleeder. The LED driver drives at least one LED and generates a current-sense signal. The current-sense signal is correlated to an LED current. The active bleeder comprises a bleeder circuit. The bleeder circuit is coupled to the LED driver to receive the current-sense signal and sinks a bleeding current in accordance with the current-sense signal for keeping the current flowing through the dimmer higher than the holding current.

20 Claims, 5 Drawing Sheets

CONTROL CIRCUIT FOR LED AND ACTIVE BLEEDER THEREOF

REFERENCE TO RELATED APPLICATIONS

This Patent Application is a Utility Application of Provisional Application No. 62/254,251, filed 12 Nov. 2015, currently pending.

BACKGROUND OF THE INVENTION

Field of Invention

The present invention relates to LED, and more specifically relates to a control circuit for LED and an active bleeder.

Description of the Related Art

The LED (Light-Emitting Diode) lamps are widely used in a variety of electronic applications due to LED lamps have significant advantages, such as long life time, small size, and high efficiency. In general, the LED system comprises a dimmer, such as TRIAC dimmer, which is used to adjust the brightness of the LED lamps. The TRIAC dimmer is triggered every half of AC cycle. While it is trigged, the current flowing through it should be kept higher than a threshold current for the remaining half AC cycle. The threshold current is called holding current. Thus, the present invention provides a control circuit for LED and an active bleeder for sinking a bleeding current in order to keep the current flowing through the dimmer higher than the holding current.

BRIEF SUMMARY OF THE INVENTION

The objective of the present invention is to provide a control circuit for LED and an active bleeder for sinking a bleeding current according to a current-sense signal correlated to an LED current, that may be used to keep the current flowing through the dimmer higher than the holding current.

A control circuit for LED according to the present invention comprises an LED driver and a bleeder circuit. The LED driver drives at least one LED and generates a current-sense signal. The current-sense signal is correlated to an LED current. The bleeder circuit is coupled to the LED driver to receive the current-sense signal and sinks a bleeding current in accordance with the current-sense signal.

An active bleeder according to the present invention comprises a bleeder circuit. The bleeder circuit is coupled to the LED driver to receive a current-sense signal and sinks a bleeding current in accordance with the current-sense signal. The current-sense signal is correlated to an LED current.

BRIEF DESCRIPTION OF THE DRAWINGS

The accompanying drawings are included to provide further understanding of the invention, and are incorporated into and constitute a part of this specification. The drawings illustrate embodiments of the invention and, together with the description, serve to explain the principles of the invention.

DETAILED DESCRIPTION OF EMBODIMENTS

Figure 1:
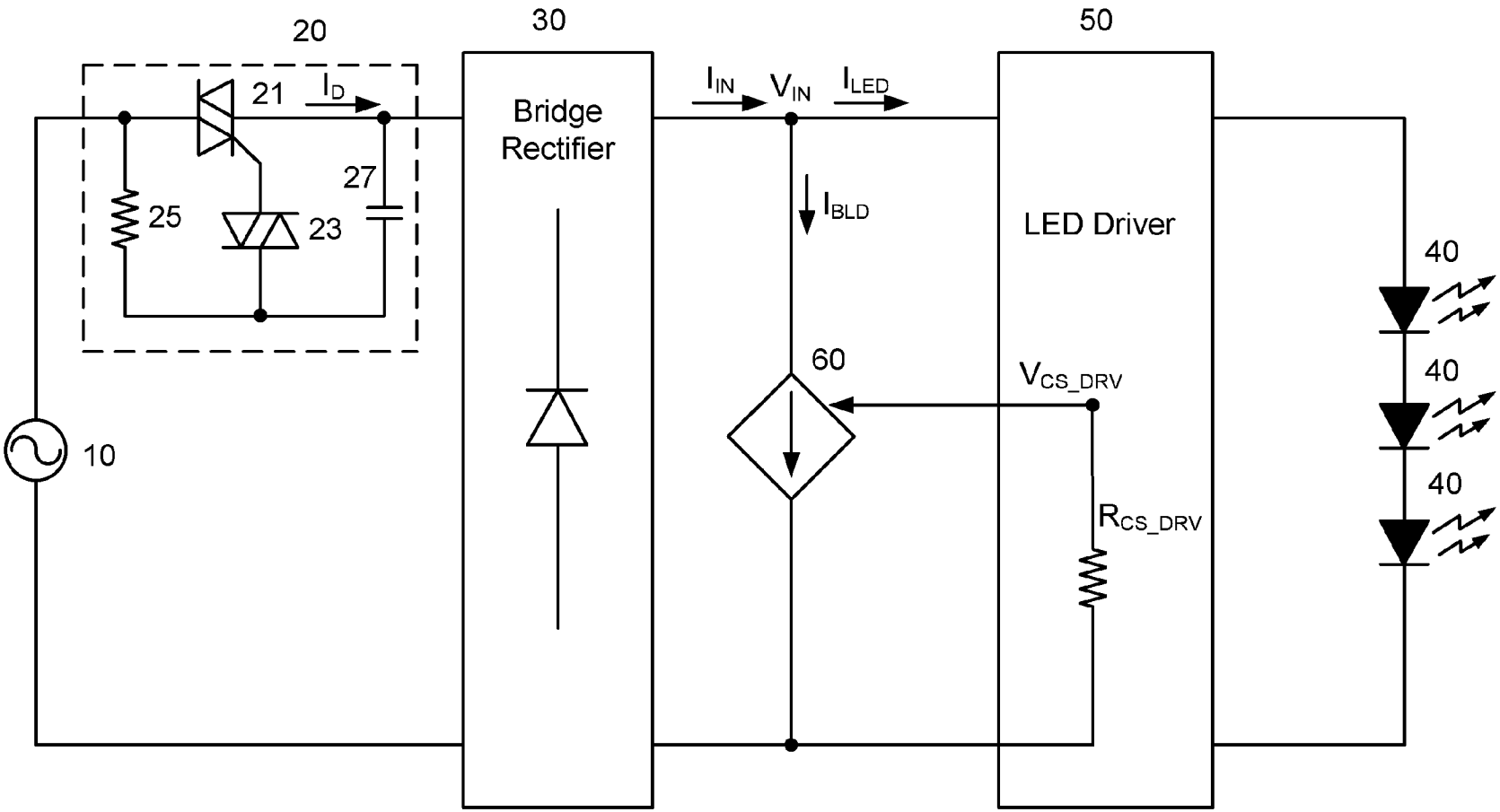
FIG. 1 is a circuit diagram of an embodiment of the LED system in accordance with the present invention.

FIG. 1 is a circuit diagram of an embodiment of the LED system in accordance with the present invention. As shown in FIG. 1, the LED system comprises an AC power source 10, a dimmer 20, a bridge rectifier 30, a plurality of LEDs 40, and a control circuit. The control circuit comprises an LED driver 50 and an active bleeder including a bleeder circuit 60. The dimmer 20 is coupled between the AC power source 10 and the bridge rectifier 30. The AC power source 10 supplies the AC power to the bridge rectifier 30 through the dimmer 20. The dimmer 20 may be a TRIAC dimmer according to one embodiment of the present invention.

The dimmer 20 comprises a tri-electrode AC switch (for example TRIAC switch 21), a Di-electrode AC switch (for example DIAC switch 23), a resistor 25, and a capacitor 27. The first terminal of the TRIAC switch 21 is coupled to the AC power source 10. The second terminal of the TRIAC switch 21 is coupled to the bridge rectifier 30. The first terminal of the DIAC switch 23 is coupled to the control terminal of the TRIAC switch 21. The first terminal of the resistor 25 is coupled to the AC power source 10 and the first terminal of the TRIAC switch 21. The second terminal of the resistor 25 is coupled to the second terminal of the DIAC switch 23 and the second terminal of the capacitor 27. The first terminal of the capacitor 27 is coupled to the second terminal of the TRIAC switch 21 and the bridge rectifier 30.

The bridge rectifier 30 rectifies the AC power for providing an input power which supplies an input voltage $V_{IN}$ and an input current $I_{IN}$. The input current $I_{IN}$ provides an LED current $I_{LED}$ for driving the LEDs 40. The LED driver 50 is coupled to the LEDs 40 to drive the LEDs 40. The LED driver 50 comprises a current-sense element $R_{CS_DRV}$ which is coupled to the LED current $I_{LED}$ for sensing the LED current $I_{LED}$ and generating a current-sense signal $V_{CS_DRV}$. The bleeder circuit 60 is coupled to the LED driver 50 to receive the current-sense signal $V_{CS_DRV}$, and sinks a bleeding current $I_{BLD}$ from the input current $I_{IN}$ in accordance with the current-sense signal $V_{CS_DRV}$. That is, the bleeder circuit 60 sinks the bleeding current $I_{BLD}$ from the input power provided by the bridge rectifier 30. Thus, the bleeder circuit 60 sinks the bleeding current $I_{BLD}$ form the AC power source 10 for increasing a current $I_D$ flowing through the dimmer 20 in order to keep the current $I_D$ higher than the holding current for maintaining the dimmer 20 in conduction state.

Figure 2:
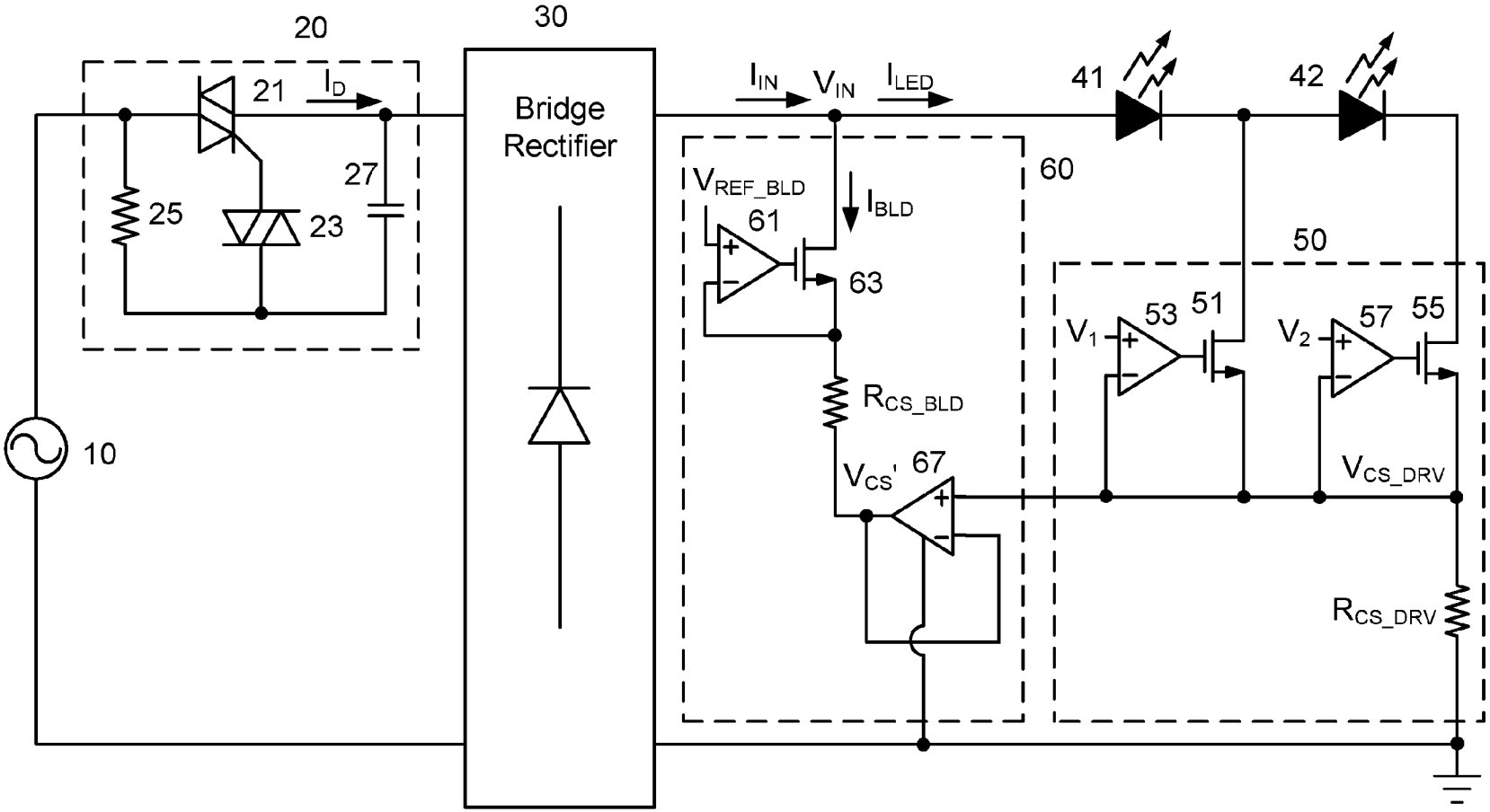
FIG. 2 is a circuit diagram of the first embodiment of the control circuit in accordance with the present invention.

FIG. 2 is a circuit diagram of the first embodiment of the control circuit in accordance with the present invention. As shown in FIG. 2, the LED driver 50 comprises a plurality of driving units and the current-sense element $R_{CS\ DRV}$. Each of the driving units comprises a transistor and an operational amplifier. The driving units are operated as the current regulators. According to this embodiment, the LED driver 50 comprises a first driving unit and a second driving unit corresponding to two LEDs 41 and 42, respectively. The LEDs 41 and 42 are coupled to each other in series.

The first driving unit comprises a first transistor 51 and a first operational amplifier 53. The second driving unit comprises a second transistor 55 and a second operational amplifier 57. The first transistor 51 is coupled between the cathode of the first LED 41 and the ground. The second transistor 55 is coupled between the cathode of the second LED 42 and the ground. The first terminal of the current-sense element $R_{CS_DRV}$ is coupled to the second terminals (source terminals) of the first transistor 51 and the second transistor 55. The second terminal of the current-sense element $R_{CS_DRV}$ is coupled to the ground. The current-sense element $R_{CS_DRV}$ is utilized to sense the LED current $I_{LED}$ flowing through the LEDs 41, 42 and generate the current-sense signal $V_{CS_DRV}$. Therefore, the current-sense signal $V_{CS_DRV}$ represents the LED current $I_{LED}$.

The negative input terminals of the operational amplifiers 53 and 57 are coupled to the first terminal of the current-sense element $R_{CS_DRV}$ to receive the current-sense signal $V_{CS_DRV}$. A first reference signal $V_1$ is supplied to the positive input terminal of the first operational amplifier 53. The output terminal of the first operational amplifier 53 is coupled to the gate terminal of the first transistor 51. The first operational amplifier 53 controls the first transistor 51 to regulate the LED current $I_{LED}$ for driving the first LED 41 in response to the current-sense signal $V_{CS_DRV}$ and the first reference signal $V_1$. A second reference signal $V_2$ is supplied to the positive input terminal of the second operational amplifier 57. The output terminal of the second operational amplifier 57 is coupled to the gate terminal of the second transistor 55. The second operational amplifier 57 controls the second transistor 55 to regulate the LED current $I_{LED}$ for driving the LEDs 41 and 42 in response to the current-sense signal $V_{CS_DRV}$ and the second reference signal $V_2$. The LED current $I_{LED}$ is determined by the first reference signal $V_1$, the second reference signal $V_2$, and the current-sense element $R_{CS_DRV}$.

Once the input voltage $V_{IN}$ is higher than the forward voltage of the first LED 41 and lower than the summation of the forward voltages of the LEDs 41 and 42, the first LED 41 is driven and the LED current $I_{LED}$ flows through the first LED 41, the first transistor 51 and the current-sense element $R_{CS_DRV}$. The second LED 42 is not driven, and therefore the LED current $I_{LED}$ doesn't flow through the second LED 42. The LED current $I_{LED}$ can be expressed as:

$$I_{LED} = \frac{V_1}{R_{CS_DRV}} \tag{1}$$

Once the input voltage $V_{IN}$ is higher than the summation of the forward voltages of the LEDs 41 and 42, the LEDs 41 and 42 are driven and the LED current $I_{LED}$ flows through the LEDs 41, 42, the second transistor 55, and the current-sense element $R_{CS_DRV}$. The LED current $I_{LED}$ can be expressed as:

$$I_{LED} = \frac{V_2}{R_{CS_DRV}} \tag{2}$$

The first driving unit (including the first transistor 51 and the first operational amplifier 53) and the second driving unit (including the second transistor 55 and the second operational amplifier 57) are operated as the current regulators for regulating the LED current $I_{LED}$. The second reference signal $V_2$ is higher than the first reference signal $V_1$, and therefore the first current regulator (upstream current regulator) is disabled when the second current regulator (downstream current regulator) regulates the LED current $I_{LED}$.

The bleeder circuit 60 comprises a current sink circuit and a buffer 67. The current sink circuit may be implemented by the voltage-to-current convertor according to one embodiment of the present invention. The voltage-to-current convertor comprises an operational amplifier 61, a transistor 63, and a resistor $R_{CS_BLD}$. The first terminal (drain terminal) of the transistor 63 is coupled to the output terminal of the bridge rectifier 30 to receive the input power, and the second terminal (source terminal) of the transistor 63 is coupled to the negative input terminal of the operational amplifier 61 and the first terminal of the resistor $R_{CS_BLD}$. A bleeding reference signal $V_{REF_BLD}$ is supplied to the positive input terminal of the operational amplifier 61. The output terminal of the operational amplifier 61 is coupled to the gate terminal of the transistor 63. The second terminal of the resistor $R_{CS_BLD}$ is coupled to the output terminal of the buffer 67. The positive input terminal of the buffer 67 is coupled to the current-sense element $R_{CS_DRV}$ of the LED driver 50 to receive the current-sense signal $V_{CS_DRV}$. The negative input terminal of the buffer 67 is coupled to the output terminal of the buffer 67. The buffer 67 is further coupled to the ground. The buffer 67 is used for buffering the current-sense signal $V_{CS_DRV}$ and generating a buffering signal $V_{CS}'$. The buffer 67 is an unity gain buffer according to one embodiment of the present invention.

The current sink circuit of the bleeder circuit 60 is coupled to the input power and the output (buffering signal $V_{CS}'$) of the buffer 67 for sinking the bleeding current $I_{BLD}$ from the input power in accordance with the current-sense signal $V_{CS_DRV}$ and the bleeding reference signal $V_{REF_BLD}$. The bleeding current $I_{BLD}$ can be expressed as:

$$I_{BLD} = \frac{V_{REF_BLD} - V'_{CS}}{R_{CS_BLD}} = \frac{V_{REF_BLD} - I_{LED} \times R_{CS_DRV}}{R_{CS_BLD}} \tag{3}$$

According to the equation (3), the bleeding current $I_{BLD}$ is adjusted according to the current-sense signal $V_{CS_DRV}$ due to the buffering signal $V_{CS}'$ is correlated to the current-sense signal $V_{CS_DRV}$. When the LED current $I_{LED}$ is lower, the buffering signal $V_{CS}'$ is also lower. Therefore, the bleeding current $I_{BLD}$ will be increased to keep the current $I_D$ flowing through the dimmer 20 higher than the holding current. When the LED current $I_{LED}$ becomes higher, the bleeding current $I_{BLD}$ will be decreased. Once the LED current $I_{LED}$ is higher than the holding current, the bleeding current $I_{BLD}$ may be decreased to zero. Accordingly, the bleeder circuit 60 acts as a current regulator, and the LED current $I_{LED}$ doesn't flow through the bleeder circuit 60.

Once the resistance value of the current-sense element $R_{CS_DRV}$ is equal to the resistance value of the resistor $R_{CS_BLD}$ and the amplitude value of the LED current $I_{LED}$ is lower than the amplitude value of the bleeding reference signal $V_{REF_BLD}$ divided by the resistance value of the resistor $R_{CS_BLD}$, the input current $I_{IN}$ can be expressed as:

$$I_{IN}\Big|_{R_{CS_DRV}=R_{CS_BLD},\, I_{LED}<\frac{V_{REF_BLD}}{R_{CS_BLD}}} = \frac{V_{REF_BLD}}{R_{CS_BLD}} \tag{4}$$

According to equation (4), the bleeding current $I_{BLD}$ keeps the input current $I_{IN}$ higher than the holding current. That is, the current $I_D$ flowing through the dimmer 20 is kept higher than the holding current.

Figure 3:
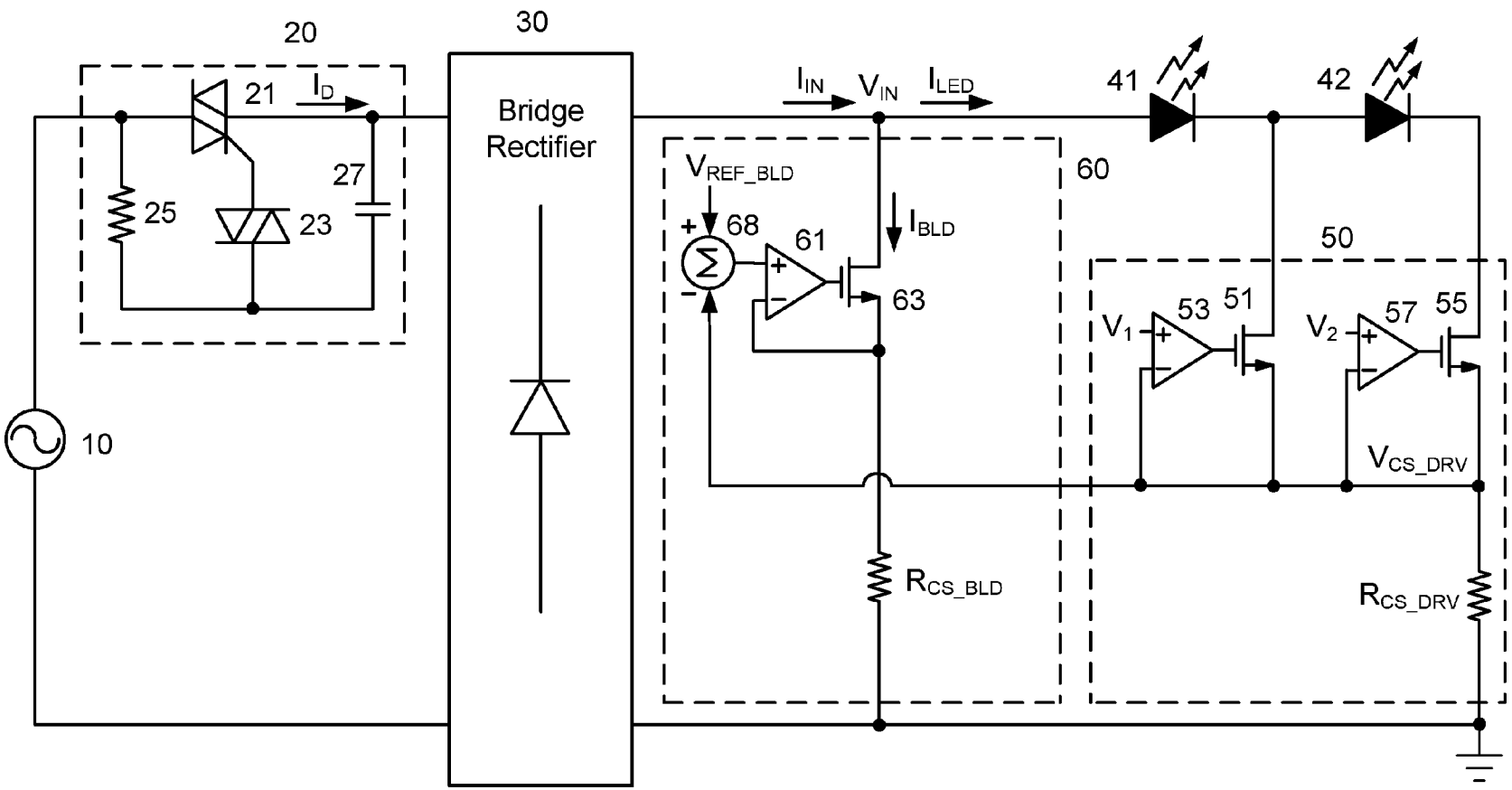
FIG. 3 is a circuit diagram of the second embodiment of the control circuit in accordance with the present invention.

FIG. 3 is a circuit diagram of the second embodiment of the control circuit in accordance with the present invention. As shown in FIG. 3, the bleeder circuit 60 of this embodiment doesn't require the buffer 67 (as shown in FIG. 2). The bleeder circuit 60 comprises the voltage-to-current convertor (the current sink circuit) and an operation unit 68. The voltage-to-current convertor comprises the operational amplifier 61, the transistor 63, and the resistor $R_{CS_BLD}$.

The first terminal of the resistor $R_{CS_BLD}$ is coupled to the negative input terminal of the operational amplifier 61 and the second terminal (source terminal) of the transistor 63. The second terminal of the resistor $R_{CS_BLD}$ is coupled to the ground. The operation unit 68 is coupled to the current-sense element $R_{CS_DRV}$ of the LED driver 50 to receive the current-sense signal $V_{CS_DRV}$. The bleeding reference signal $V_{REF_BLD}$ is supplied to the operation unit 68. The operation unit 68 generates an output signal in response to the current-sense signal $V_{CS_DRV}$ and the bleeding reference signal $V_{REF_BLD}$. The operation unit 68 generates the output signal by subtracting the level of the current-sense signal $V_{CS_DRV}$ from the level of the bleeding reference signal $V_{REF_BLD}$. The operation unit 68 serves as a subtractor. The output terminal of the operation unit 68 is coupled to the positive input terminal of the operational amplifier 61, and therefore the output signal of the operation unit 68 is supplied to the positive input terminal of the operational amplifier 61. Accordingly, the current sink circuit of this embodiment sinks the bleeding current $I_{BLD}$ from the input power in accordance with the output signal of the operation unit 68.

The bleeding current $I_{BLD}$ can be expressed as:

$$I_{BLD} = \frac{V_{REF_BLD} - V_{CS_DRV}}{R_{CS_BLD}} = \frac{V_{REF_BLD} - I_{LED} \times R_{CS_DRV}}{R_{CS_BLD}} \quad (5)$$

According to the equation (5), the bleeding current $I_{BLD}$ is adjusted according to the current-sense signal $V_{CS_DRV}$. When the LED current $I_{LED}$ is lower, the current-sense signal $V_{CS_DRV}$ is also lower, and therefore the output signal ($V_{REF_BLD}-V_{CS_DRV}$) is increased, that the bleeding current $I_{BLD}$ will be increased to keep the current $I_D$ flowing through the dimmer 20 higher than the holding current. When the LED current $I_{LED}$ becomes higher, the output signal ($V_{REF_BLD}-V_{CS_DRV}$) is decreased. Therefore, the bleeding current $I_{BLD}$ will be decreased.

Once the resistance value of the current-sense element $R_{CS_DRV}$ is equal to the resistance value of the resistor $R_{CS_BLD}$ and the amplitude value of the LED current $I_{LED}$ is lower than the amplitude value of the bleeding reference signal $V_{REF_BLD}$ divided by the resistance value of the resistor $R_{CS_BLD}$, the input current $I_{IN}$ can be expressed as:

$$I_{IN}\Big|_{R_{CS_DRV}=R_{CS_BLD},\, I_{LED}<\frac{V_{REF_BLD}}{R_{CS_BLD}}} = \frac{V_{REF_BLD}}{R_{CS_BLD}} \quad (6)$$

According to equation (6), the bleeding current $I_{BLD}$ keeps the input current $I_{IN}$ higher than the holding current. That is, the current $I_D$ is kept higher than the holding current.

Figure 4:
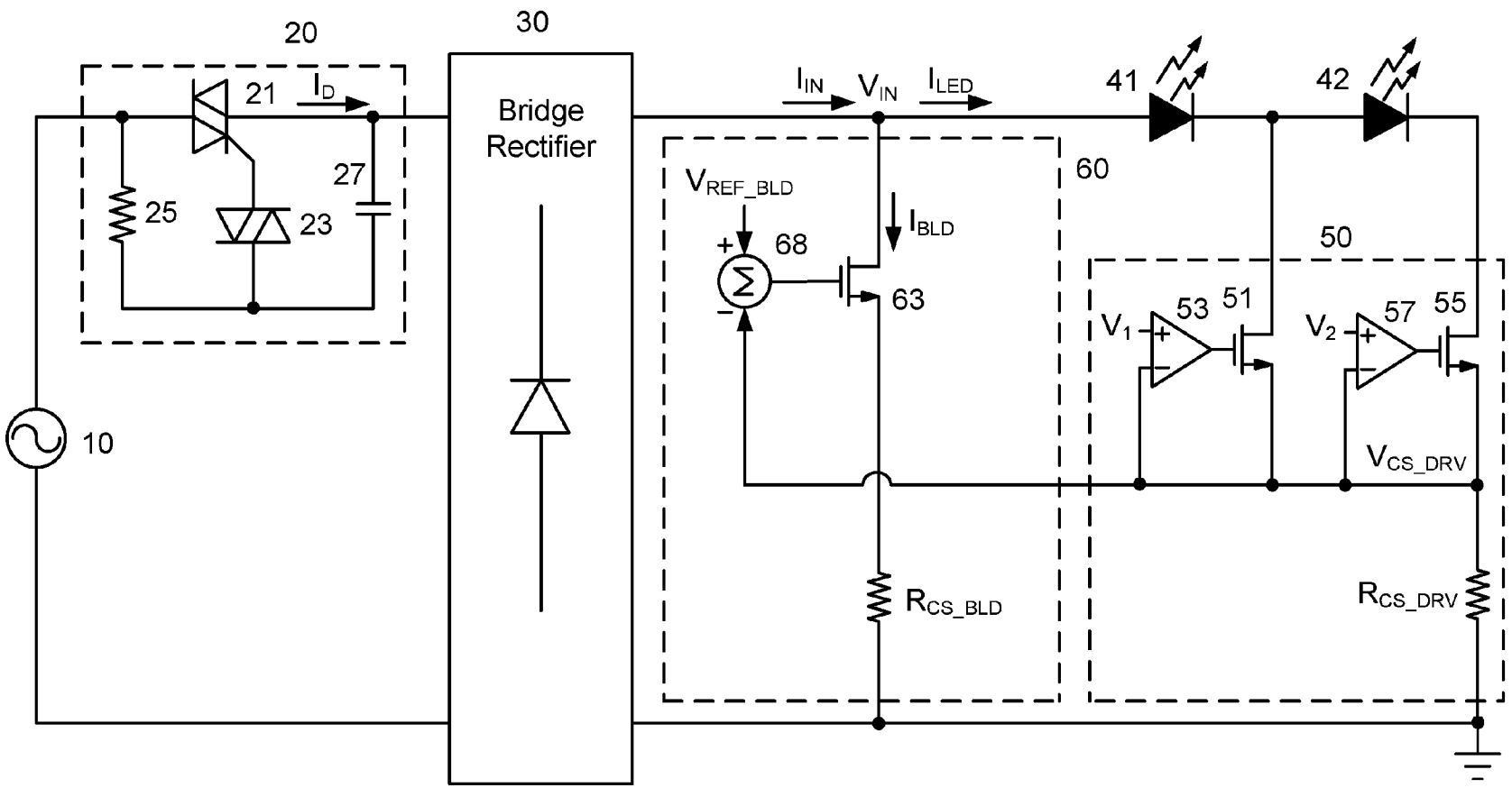
FIG. 4 is a circuit diagram of the third embodiment of the control circuit in accordance with the present invention.

FIG. 4 is a circuit diagram of the third embodiment of the control circuit in accordance with the present invention. As shown in FIG. 4, the bleeder circuit 60 of this embodiment doesn't require the operational amplifier 61 (as shown in FIG. 3). The bleeder circuit 60 of this embodiment comprises the transistor 63, the operation unit 68, and the resistor $R_{CS_BLD}$. The operation unit 68 generates the output signal in response to the current-sense signal $V_{CS_DRV}$ and the bleeding reference signal $V_{REF_BLD}$. The operation unit 68 serves as a subtractor. The output terminal of the operation unit 68 is coupled to the gate terminal of the transistor 63, and therefore the output signal of the operation unit 68 is coupled to the gate terminal of the transistor 63 to control the transistor 63.

The bleeding current $I_{BLD}$ is regulated by characteristic of the transistor 63. When the source voltage of the transistor 63 is lower than the gate voltage minus the threshold voltage, the transistor 63 will be turned on. When the source voltage of the transistor 63 is higher than the gate voltage minus the threshold voltage, the transistor 63 will be turned off. Therefore, the bleeding current $I_{BLD}$ will be regulated. The bleeding current $I_{BLD}$ can be expressed as:

$$I_{BLD} = \frac{V_G - V_{TH}}{R_{CS_BLD}} \quad (7)$$

The $V_G$ represents the gate voltage of the transistor 63, and the $V_{TH}$ represents the threshold voltage of the transistor 63. The amplitude of the output signal of the operation unit 68 is the gate voltage of the transistor 63. Therefore, the transistor 63 is controlled by the output signal of the operation unit 68 for sinking the bleeding current $I_{BLD}$ from the input power in accordance with the output signal. The gate voltage of the transistor 63 is controlled by the amplitude of the bleeding reference signal $V_{REF_BLD}$ and the amplitude of the current-sense signal $V_{CS_DRV}$. The bleeding current $I_{BLD}$ will be increased when the LED current $I_{LED}$ is lower.

Figure 5:
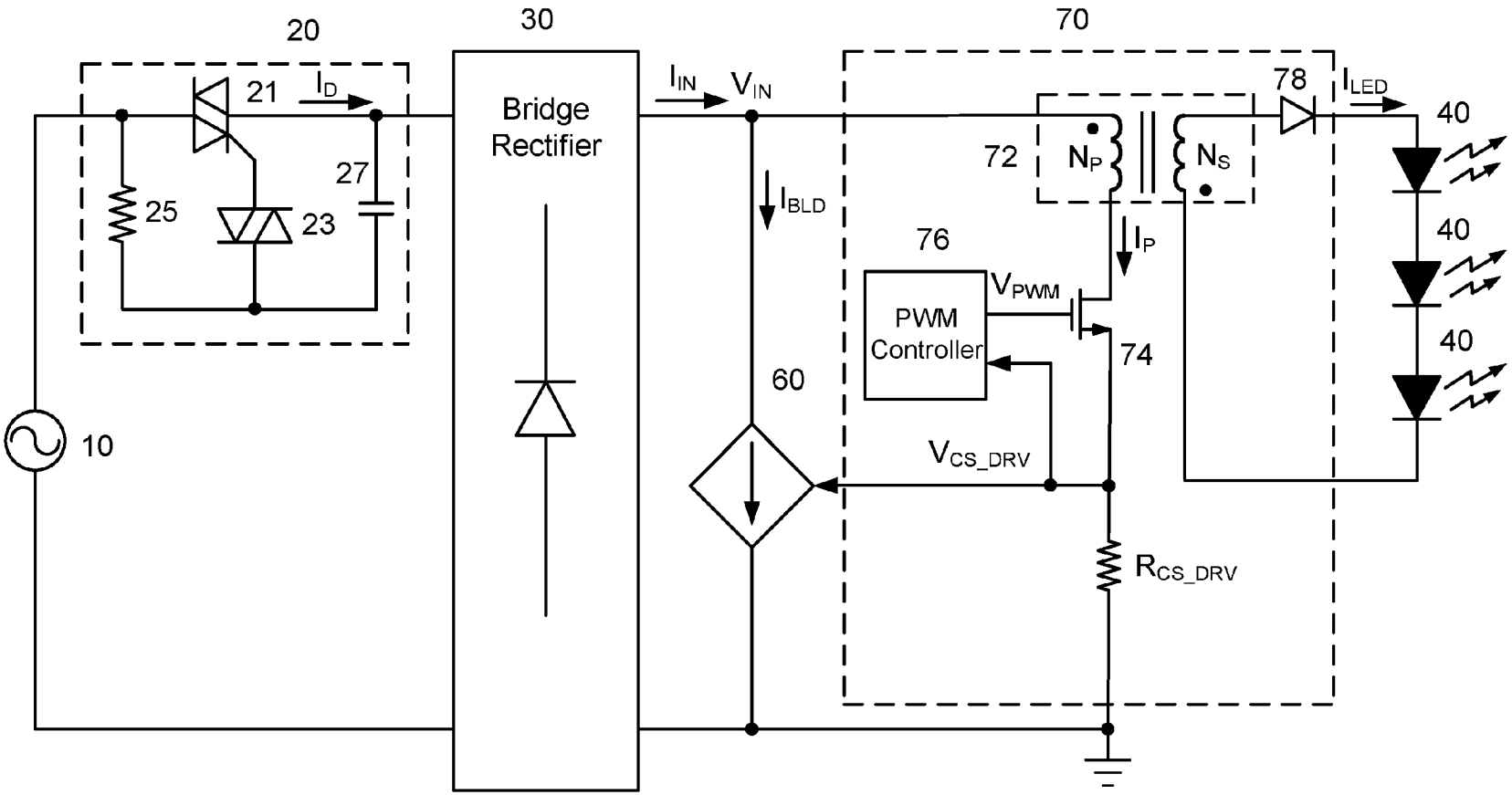
FIG. 5 is a circuit diagram of another embodiment of the LED system in accordance with the present invention.

FIG. 5 is a circuit diagram of another embodiment of the LED system in accordance with the present invention. In embodiments shown in FIGS. 2-4, the LED drivers are progressive forward-biased linear LED drivers, however the LED driver of the present invention is not limited to that application. The LED driver can be a switching regulator.

As shown in FIG. 5, the LED driver 70 comprises a transformer 72, a power switch 74, a PWM (Pulse Width Modulation) controller 76, and the current-sense element $R_{CS_DRV}$. The transformer 70 includes a primary winding $N_P$ and a secondary winding $N_S$. The secondary winding $N_S$ generates the LED current $I_{LED}$ via a rectifier 78. The first terminal of the rectifier 78 is coupled to the first terminal of the secondary winding $N_S$. The LEDs 40 is coupled between the second terminal of the rectifier 78 and the second terminal of the secondary winding $N_S$.

The first terminal of the primary winding $N_P$ is coupled to the output terminal of the bridge rectifier 30 to receive the input voltage $V_{IN}$. The first terminal of the power switch 74 is coupled to the second terminal of the primary winding $N_P$. The current-sense element $R_{CS_DRV}$ is coupled between the second terminal of the power switch 74 and the ground for generating the current-sense signal $V_{CS_DRV}$. The PWM controller 76 is coupled to the first terminal of the current-sense element $R_{CS_DRV}$ to receive the current-sense signal $V_{CS_DRV}$. The PWM controller 76 generates a switching signal $V_{PWM}$ in response to the current-sense signal $V_{CS_DRV}$ to switch the power switch 74 for regulating the LED current $I_{LED}$. When the power switch 74 is turned on, a switching current $I_P$ flows through the power switch 74. The switching current $I_P$ is proportional to the LED current $I_{LED}$. The current-sense element $R_{CS_DRV}$ is used to sense the witching current $I_P$ for generating the current-sense signal $V_{CS_DRV}$. That is, the current-sense element $R_{CS_DRV}$ is used to sense the LED current $I_{LED}$, and the current-sense signal $V_{CS_DRV}$ is correlated to the LED current $I_{LED}$.

The bleeder circuit 60 is coupled to the current-sense element $R_{CS_DRV}$ to receive the current-sense signal $V_{CS_DRV}$ for sinking the bleeding current $I_{BLD}$ in accordance with the current-sense signal $V_{CS_DRV}$, that is used to keep the current $I_D$ flowing through the dimmer 20 higher than the holding current for keeping the dimmer 20 in conduction state.

Although the present invention and the advantages thereof have been described in detail, it should be understood that various changes, substitutions, and alternations can be made therein without departing from the spirit and scope of the invention as defined by the appended claims. That is, the discussion included in this invention is intended to serve as a basic description. It should be understood that the specific discussion may not explicitly describe all embodiments possible; many alternatives are implicit. The generic nature of the invention may not fully explained and may not explicitly show that how each feature or element can actually be representative of a broader function or of a great variety of alternative or equivalent elements. Again, these are implicitly included in this disclosure. Neither the description nor the terminology is intended to limit the scope of the claims.

What is claimed is:

1. A control circuit for LED, comprising:

an LED driver configured to drive at least one LED and to form a current-sense signal correlated to an LED current; and a bleeder circuit coupled to the LED driver to receive the current-sense signal and configured to sink a bleeding current in accordance with the current-sense signal.

2. The control circuit as claimed in claim 1, wherein the bleeder circuit sinks the bleeding current from a power source for increasing a current flowing through a dimmer.

3. The control circuit as claimed in claim 1, wherein the bleeding current is increased when the LED current flowing through the LED is decreased.

4. The control circuit as claimed in claim 1, wherein the bleeder circuit comprises:

a buffer coupled to the LED driver to receive the current-sense signal; and a current sink circuit coupled to receive an input power and coupled to an output of the buffer for sinking the bleeding current from the input power in accordance with the current-sense signal and a bleeding reference signal.

5. The control circuit as claimed in claim 1, wherein the bleeder circuit comprises:

an operation unit coupled to the LED driver to receive the current-sense signal and configured to generate an output signal in response to the current-sense signal and a bleeding reference signal; and a current sink circuit coupled to receive an input power and coupled to an output of the operation unit for sinking the bleeding current from the input power in accordance with the output signal of the operation unit.

6. The control circuit as claimed in claim 1, wherein the bleeder circuit comprises:

an operation unit coupled to the LED driver to receive the current-sense signal and configured to generate an output signal in response to the current-sense signal and a bleeding reference signal; and a transistor coupled to receive an input power and controlled by the output signal of the operation unit for sinking the bleeding current from the input power in accordance with the output signal.

7. The control circuit as claimed in claim 1, wherein the LED driver comprises at least one driving unit comprises:

a transistor coupled between the at least one LED and a ground; and an operational amplifier controlling the transistor for driving the at least one LED in response to a reference signal.

8. The control circuit as claimed in claim 1, wherein the LED driver comprises a current-sense element sensing the LED current for generating the current-sense signal.

9. The control circuit of claim 1 wherein the LED drive includes a PWM controller configured to form the LED current and to generate the current sense signal.

10. The control circuit of claim 1 wherein the bleeder circuit includes a buffer coupled to the LED driver to receive the current-sense signal; and a current sink circuit having a transistor coupled to receive an input power and configured to sink the bleeding current from the input power in accordance with the current-sense signal and a bleeding reference signal.

11. The control circuit of claim 1 wherein the bleeder circuit includes a subtractor coupled to the LED driver to receive the current-sense signal and configured to generate an output signal in response to the current-sense signal and a bleeding reference signal; and a current sink circuit coupled to receive an input power and coupled to an output of the subtractor for sinking the bleeding current from the input power in accordance with the output signal of the subtractor.

12. An active bleeder, comprising:

a bleeder circuit coupled to an LED driver to receive a current-sense signal and configured to sink a bleeding current in accordance with the current-sense signal, wherein the current-sense signal is correlated to an LED current.

13. The active bleeder as claimed in claim 12, wherein the bleeder circuit is configured to sink the bleeding current from a power source for increasing a current flowing through a dimmer.

14. The active bleeder as claimed in claim 12, wherein the bleeding current is increased when the LED current flowing through the LED is decreased.

15. The active bleeder as claimed in claim 12, wherein the bleeder circuit comprises:

a buffer coupled to the LED driver to receive the current-sense signal; and a current sink circuit coupled to receive an input power and coupled to an output of the buffer for sinking the bleeding current from the input power in accordance with the current-sense signal and a bleeding reference signal.

16. The active bleeder as claimed in claim 12, wherein the bleeder circuit comprises:

an operation unit coupled to the LED driver to receive the current-sense signal and configured to generate an output signal in response to the current-sense signal and a bleeding reference signal; and a current sink circuit coupled to receive an input power and coupled to an output of the operation unit for sinking the bleeding current from the input power in accordance with the output signal of the operation unit.

17. The active bleeder as claimed in claim 12, wherein the bleeder circuit comprises:

an operation unit coupled to the LED driver to receive the current-sense signal and configured to generate an output signal in response to the current-sense signal and a bleeding reference signal; and a transistor coupled to receive an input power, the transistor controlled by the output signal of the operation unit for sinking the bleeding current from the input power in accordance with the output signal.

18. The active bleeder as claimed in claim 12, wherein the LED driver comprises at least one driving unit comprises:

a transistor configured to be coupled between an LED and a ground; and an operational amplifier coupled to control the transistor for driving the LED in response to a reference signal.

19. The active bleeder as claimed in claim 12, wherein the LED driver comprises a current-sense element configured to sense the LED current for generating the current-sense signal.

20. The active bleeder of claim 12 wherein the bleeder circuit comprises:

a subtractor coupled to the LED driver to receive the current-sense signal and configured to generate an output signal in response to the current-sense signal and a bleeding reference signal; and a transistor controlled in response to the output signal of the subtractor.

* * * * *